US007563077B2

(12) United States Patent
Santa Ana

(10) Patent No.: US 7,563,077 B2
(45) Date of Patent: Jul. 21, 2009

(54) QUIET FLUID PUMP

(76) Inventor: Roland C. Santa Ana, 224 N. Van Buren St., Rockville, MD (US) 20850

( * ) Notice: Subject to any disclaimer, the term of this patent is extended or adjusted under 35 U.S.C. 154(b) by 610 days.

(21) Appl. No.: 11/288,559

(22) Filed: Nov. 29, 2005

(65) Prior Publication Data

US 2006/0147316 A1 Jul. 6, 2006

(30) Foreign Application Priority Data

Sep. 27, 2004 (WO) ..... PCT/US2004/031451

(51) Int. Cl.
*F04B 53/00* (2006.01)
*F04B 39/00* (2006.01)

(52) U.S. Cl. ..... 417/234; 417/312

(58) Field of Classification Search ..... 181/175, 181/252; 417/312, 234, 313, 360, 363, 542; 137/565.17, 565.18, 899.4
See application file for complete search history.

(56) References Cited

U.S. PATENT DOCUMENTS

| | | | | | |
|---|---|---|---|---|---|
| 2,721,028 | A * | 10/1955 | Dills | 181/200 |
| 2,935,244 | A * | 5/1960 | Dills | 417/415 |
| 3,612,213 | A * | 10/1971 | Piko | 181/200 |
| 4,022,550 | A * | 5/1977 | Brink et al. | 417/234 |
| 4,264,282 | A * | 4/1981 | Crago | 417/243 |
| 4,302,160 | A * | 11/1981 | Hofmann, Jr. | 417/313 |
| 4,347,042 | A * | 8/1982 | Holdsworth | 417/53 |
| 4,842,492 | A * | 6/1989 | Gannaway | 417/312 |
| 4,844,701 | A * | 7/1989 | Wolford et al. | 417/234 |
| 4,938,309 | A * | 7/1990 | Emdy | 181/231 |
| 4,982,812 | A * | 1/1991 | Hwang | 181/202 |
| 4,988,268 | A * | 1/1991 | Kurihara | 417/312 |
| 5,002,467 | A * | 3/1991 | Talaski et al. | 417/363 |
| 5,151,018 | A * | 9/1992 | Clendenin et al. | 417/312 |
| 5,272,285 | A * | 12/1993 | Miller | 181/202 |
| 5,613,843 | A * | 3/1997 | Tsuru et al. | 417/313 |
| 6,089,835 | A * | 7/2000 | Suzuura et al. | 417/415 |
| 6,155,805 | A * | 12/2000 | Fry | 417/415 |
| 6,554,583 | B1 * | 4/2003 | Pressel | 417/271 |
| 6,582,201 | B2 * | 6/2003 | Lucchi | 417/234 |
| 2002/0106282 | A1 * | 8/2002 | Sharp et al. | 417/201 |
| 2004/0047745 | A1 * | 3/2004 | Burkholder et al. | 417/234 |

* cited by examiner

*Primary Examiner*—Devon C Kramer
*Assistant Examiner*—Alexander B Comley
(74) *Attorney, Agent, or Firm*—Dennis G. LaPointe

(57) ABSTRACT

A quiet fluid compressor which is made up of a motor, a compressor, and a storage tank. The motor and the compressor are cylindrical in shape and are joined to each other. The tank is cylindrical in shape and has a central open area going from the top to the bottom of the tank. The compressor/motor unit fits within this open area. The tank surrounding the compressor/motor unit absorbs noise created by the compressor. There is a top opening of the central open area. This opening is covered by a louvered cover containing sound-absorbing foam which prevents emanation of sound. There is a bottom covering containing a plurality of openings which breaks up the sound and prevents redirection of sound through the top opening. The inside of the tank is coated with sound-absorbing foam.

14 Claims, 3 Drawing Sheets

QUIET FLUID PUMP

SEQUENCE LISTING OR PROGRAM

Not Applicable

FEDERALLY SPONSORED RESEARCH

Not Applicable

CROSS REFERENCE TO RELATED APPLICATIONS

This application claims priority from International PCT Application PCT/US2004/031451, entitled "Quiet Fluid Pump", filed on Sep. 27, 2004.

TECHNICAL FIELD OF THE INVENTION

The technical field of this invention is fluid pumps. More particularly, the field is portable pumps, such as air compressors, vacuum cleaners, and liquid pumps.

INDUSTRIAL APPLICABILITY

The present invention finds industrial applicability wherever fluid compressors are used. The conventional compressor creates sufficient noise to be annoying and detrimental to hearing. The device of the present invention decreases or eliminates the noise emanating from the compressor and results in a more environmentally acceptable device.

BACKGROUND OF THE INVENTION

U.S. Pat. No. 5,370,504 issued to Nagashima on Oct. 12, 1993 discloses an ambulant reciprocating compressor having plural pressure collection chambers. A pair of oppositely directed pistons is mounted in a cylinder in a reciprocating manner. The cylinder is formed unilaterally with, and is encapsulated within, a tank for receiving compressed air and has an exhaust port at each end and a valve for controlling the flow of air into the tank. Each piston has a head with an aperture and a unidirectional valve for controlling air flow into the cylinder. An air inlet to the cylinder is located between the piston heads. A motor which has a drive shaft extending through the air inlet and a transmission connected to the pistons drives the pistons synchronously in opposing, reciprocating strokes. The compressor of this patent produces less noise caused by vibration because there is no piping in the apparatus and the fittings and attachments for the compressor are all installed inside the body. The apparatus of the patent fails to decrease noise as fully as desired. The essentially solid wall adjacent the outlet valve reflects noise back out the intake opening and there is no noise protector at the intake opening.

U.S. Pat. No. 6,099,268 issued to Pressel on Aug. 8, 2000 represents the closest prior art known by the inventor. This patent discloses an air compressor system which is characterized by being made up of a swash plate type of air compressor which is capable of delivering pressures up to about 200 p.s.i. The system is selectively and interchangeably insertable into holding tanks of different sizes and configurations for different specific applications. The holding tanks have inner tank liners and a connecting valve between the compressor and liner to deliver pressurized air from the compressor into the storage compartment defined by the liner within the tank. The tank and its liner can serve as a self-contained source of pressurized air which can be selectively discharged as required so that the compressor itself may be disconnected from the tank and successively connected to a number of different or additional tanks. This patent is concerned with noise reduction in a system containing a tank, a motor and a pneumatic compressor. Noise is reduced by a muffler sleeve on the tank liner, a plurality of baffle ports which allow air into the liner, curved vanes in the bottom of the tank liner, and vibration-dampening attachment bolts. This system is partially effective for its intended purpose. However, there is room for improvements. The tank assembly has a closed bottom which acts as a sounding board to reflect noise upward and into the environment. Additionally, the top of the compressor assembly is covered by a screen which offers no resistance to noise produced by the compressor being transmitted to the environment.

U.S. Pat. No. 6,361,293 issued to Harper on Mar. 26, 2002 discloses a hermetic compressor which includes a housing and a compressor subassembly resiliently supported within the housing. The compressor subassembly includes a motor drivingly coupled to a compressor mechanism by means of a shaft. A motor enclosure is connected to the compressor mechanism and encases the motor. A pair of grommets is disposed between the housing and the compressor subassembly whereby the compressor subassembly is resiliently suspended within the housing. The compressor mechanism discharges compressed gas into the housing through an aperture located in the motor enclosure and a quantity of oil is disposed in a lower portion of the housing. The aperture is submerged in the quantity of oil and the discharge gas exiting through the aperture is urged through the quantity of oil forming a sound damping foam. A main bearing is connected to the motor enclosure. A first discharge chamber is defined by the main bearing and the inner surface of the motor enclosure and a second discharge chamber is defined by the inner surface of the housing and an outer surface of the compressor subassembly. The first and second discharge chambers constitute a pair of mufflers to consecutively receive a quantity of discharge gas and respectively muffle the gas being respectively discharged therefrom. A method of assembling the rotary compressor includes inserting a mounting tool into a hole in the projecting portion of the motor enclosure and aligning a stator-rotor air gap prior to assembling the compressor subassembly within resilient mounts attached to the housing. When the air emitted from the device of this invention is to used for inhalation by humans, such as in the well-known CPAP machine, the passage of the air through oil may produce air bearing harmful droplets of oil and thus be unsatisfactory for its intended purpose. Additionally, the incorporation of additional heavy oil is not desirable in the production of portable compressor devices.

U.S. Pat. No. 2,964,236 issued to Kasper on Dec. 19, 1960 discloses a suction motor mounting construction. A suction cleaner has a motor mounted within a tank. The device of Kasper is a vacuum cleaner in which air is forced by a fan through a filter to remove solid particles. There is no apparent consideration of noise reduction in this disclosure.

U.S. Pat. No. 4,964,609 issued to Tomell on Oct. 23, 1990 discloses a vertically upright hermetic compressor for mounting to a horizontal support surface, having a housing, a motor compressor unit within the housing, and a mounting piece. The object of the Tomell invention is to diminish undesirable noise emanating from the bottom of the compressor units. To accomplish this object, the mounting piece is removably attached to the housing's bottom end for mounting the compressor to the horizontal support surface. It has a resilient body engaged about the housing to cover the housing bottom. While effective for its purpose, the Tomell device is only partially effective in producing a quiet motor/compressor, and there is considerable room for improvement in this area.

U.S. Pat. No. 4,961,018 issued to Akhter on Oct. 2, 1990 discloses an enclosed pump motor includes an aluminum housing made by an impact extrusion process. The housing is cylindrical having an integrally-formed closed end with integral fastener bosses for attaching a pump thereto and an integrally-formed thickened cylindrical portion defining a shaft bore for receiving the motor shaft. At the other end, the cylindrical housing is open for receiving the motor. A motor cover is attached to the motor receiving end of the housing by crimping or bending a part of the housing into indents formed in the housing. The motor cover includes a threaded bore adapted to receive a threaded grommet wherein three connector pins are imbedded. The connector pins are connected to electrical power carrying conductors and/or switch conductors leading to a fluid level sensor switch. The conductor-to-pin connections are imbedded within the grommet and are hermetically sealed. The connector pins extend into the housing and are electrically connected to corresponding connectors leading to the electric motor. The motor is enclosed within a housing which is in direct contact with surrounding environment. No effort is made to reduce the noise generated by the motor or pump.

U.S. Pat. No. 6,447,264 issued to Lucas on Sep. 10, 2002 discloses a compressor system having a first compartment for housing relatively quietly operating equipment, and a second compartment for housing relatively noisily operating equipment. The second compartment is substantially closed off from the surrounding atmosphere to reduce the amount of noise that can be heard outside the compressor system on account of the noisy equipment operating within the compressor system housing. The second compartment includes a small air inlet opening and a small air outlet opening to allow enough air to flow through the second compartment to cool the equipment housed therein. The small openings reduce the amount of airborne noise which is released to the outside environment. The compressor system also has an air intake directing device for directing an appropriate amount of air into the second compartment to cool the noise generating machinery located within the second compartment, and for directing an appropriate amount of air to an air inlet opening of a compressor, thereby more efficiently using the air drawn into the compressor system housing. By separating the several parts of the system, Lucas creates a system which is larger than necessary. In the preparation of portable devices, this is disadvantageous. There is no provision for preventing the noise generated by the relatively noisy components from being transmitted to the environment through the intake opening.

Patent application number US2002/0009372A1 by Gruber published on Jan. 24, 2002 discloses an air compressor assembly with a shroud. An apparatus comprises a tank, an air compressor, and a motor with an output shaft. A fan is mounted on the output shaft. A drive assembly interconnects the motor operatively with the compressor. The apparatus further includes a base structure and a shroud. The base structure is configured to support the compressor, the motor and the drive assembly on the tank. The shroud is configured to cover the compressor, the motor, the drive assembly and the base structure on the tank. The shroud has a cooling air inlet port and a cooling air outlet port. A plurality of internal wall portions of the shroud are configured to direct cooling air to flow over the motor and the compressor upon flowing through the cover from the inlet port to the outlet port under the influence of the fan. The fact that the tank supports the operational components means that the apparatus is larger than it should be which is a disadvantage in portable apparatuses.

U.S. Pat. No. 6,308,899 issued to Crofford on Oct. 30, 2001 discloses a compact, highly portable, multi-mode fluid injection system able to reach difficult-to-access places to efficiently service pipes, tubing and related components having a variety of diameters. The system comprises a tank having a first port which allows access to the tank's upper contents and a second port which allows access to the tank's lower contents, a means for introducing liquid into the tank, a hand pump built into the tank to pressurize the tank and its contents, one or more applicators, and flexible hoses which connect the applicators to the first and/or second port to supply the applicators with the tank's contents. The system is capable of producing, alternatively, pressurized liquid or gas without an independently powered air compressor or consumable gas cartridges, and without having to empty and/or fill the tank. An onboard means for stowing the hose conduits, and injection gun applicator having a small travel high-flow valve with adjustable accumulation chamber, and applicators having stiff-flexible tips and tip extensions is disclosed. This system does not contain a motor or a compressor, and is not concerned with noise abatement.

As can be seen from the above-discussed publications, noise produced by air compressors is a persistent problem. Operators of pneumatic equipment are forced to wear ear protectors or risk hearing loss due to noisy conditions which exceed OSHA standards. In spite of the recognition of this problem and the various approaches to solve this problem, the noise produced by fluid compressors still exists.

SUMMARY OF THE INVENTION

The present invention brings a solution to the above-discussed problem. The object of the present invention is to provide a fluid compressor device which operates with less emanation of noise. The fluid compressor device may be used for conventional purposes, such as operating pneumatic tools, inflation of inflatable objects, compression of air conditioning or refrigerant fluids, operating vacuum cleaners, and other well known utilities.

Ideally, the fluid compressor device of this invention is portable and may be transported by either a handle attached to the device or an attached dolly.

The compressor or pump used in this invention is not critical and may be any conventional compressor.

Likewise, a conventional motor may be used to power the pump of the compressor. Ideally, the motor is powered by electricity but fuel-powered motors or motors driven by any other source of power may be used.

The compressor and the motor for the compressor are lined up end to end. There may be a plurality of compressors and motors, in which case they are lined up end to end in an alternating fashion. The compressor/motor unit is cylindrical in shape and has a fan driven by the motor at either the top or bottom end.

There is a storage tank for the compressed fluid. The tank has a closed outer cylindrical surface, a closed inner cylindrical surface, a closed outer top surface, and a closed outer bottom surface.

A utility attachment fits on the top of the closed outer top surface. The utility attachment contains the necessary switches, gauges, and hoses.

A tunnel extends from the top surface to the bottom surface inside the closed inner cylindrical surface. The compressor/motor unit and fan fit within this tunnel. The bottom end of the tunnel is covered with a bottom cover which contains a plurality of openings to permit the passage of exhaust gas. The top end of the tunnel is covered with a noise-retarding air intake cover.

The noise-producing elements, the compressor and the motor, are inside the device and the cylindrical tank serves as a muffler to absorb the noise generated by these features. The bottom end of the tunnel is open and thus does not reflect noise. The top end of the tunnel is covered with a foam filter and absorbs noise generated by the noise-producing elements.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION AND BEST MODE OF THE INVENTION

Figure 1:
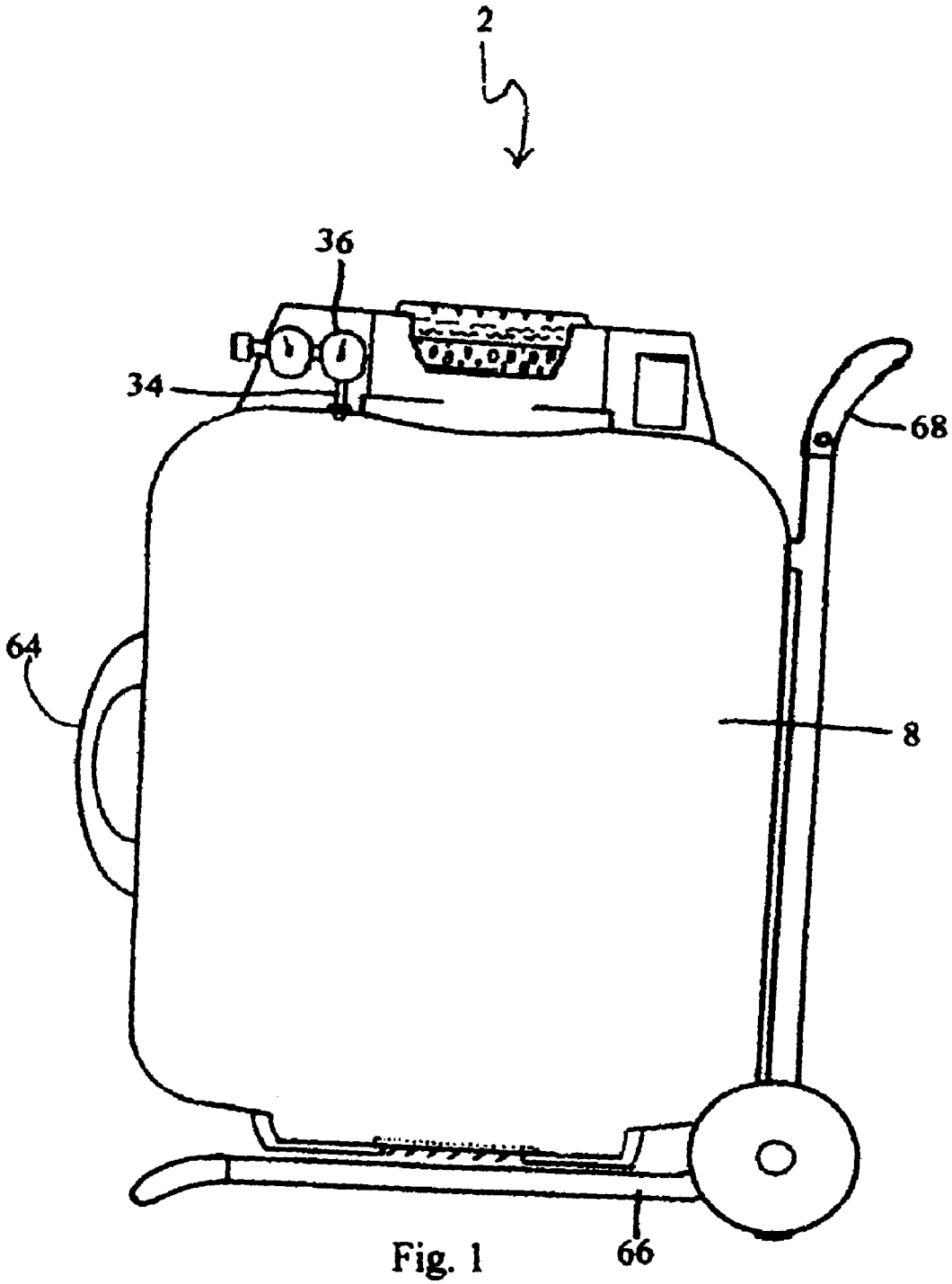
FIG. 1 is an elevational side view of the device of this invention made portable with a handle and a dolly.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced.

These embodiments are described in sufficient detail to enable those skilled in the art to practice the invention, but other embodiments may be utilized and logical, mechanical, electrical, and other changes may be made without departing from the scope of the present invention. The following detailed description is therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

The device 2 of the invention is composed of three main parts: a compressor 4 or pump (hereinafter referred to as compressor), a motor 6, and a storage tank 8.

Small compressors 4 are well known in the art. The compressor 4 of this invention may be any small compressor 4 such as any of those set forth in the above-discussed publications. The compressor 4 may be of any cross-sectional shape, but is preferable cylindrical in shape.

In the same manner, motors 6 to operate the compressor 4 are well known in the art. The motor 6 is preferably operated by an electrical power supply. However, any power supply is suitable. As with the compressor 4, the motor 6 may be any shape but is preferably cylindrical.

The compressor 4 and the motor 6 are aligned end to end. There may be more than one compressor 4 and the motor 6 per device 2. When this is the case, the compressors 4 and the motors 6 alternate and line up end to end. When considered as a unit the combination of the compressor 4 and the motor 6 shall be referred to as the compressor/motor unit 10.

There is a fan 12 attached to either the incoming end 14 or the exhaust end 16 of the compressor/motor unit 10. This fan 12 is used for cooling the device 2 and helping to push spring pistons 18 of the compressor 4 to a pre-load position. It is preferred to have this fan 12 at the incoming end 14 when filtered air is being sucked through the tunnel 20 to divert the piston cylinder 22 and motor 6 to serve as an air supply as well as cooling agent. It is preferred to have this fan 12 at the exhaust end 16 when the compressor/motor unit 10 is compact in design or as an option for additional cooling fan 12 for high-performance use.

Figure 2:
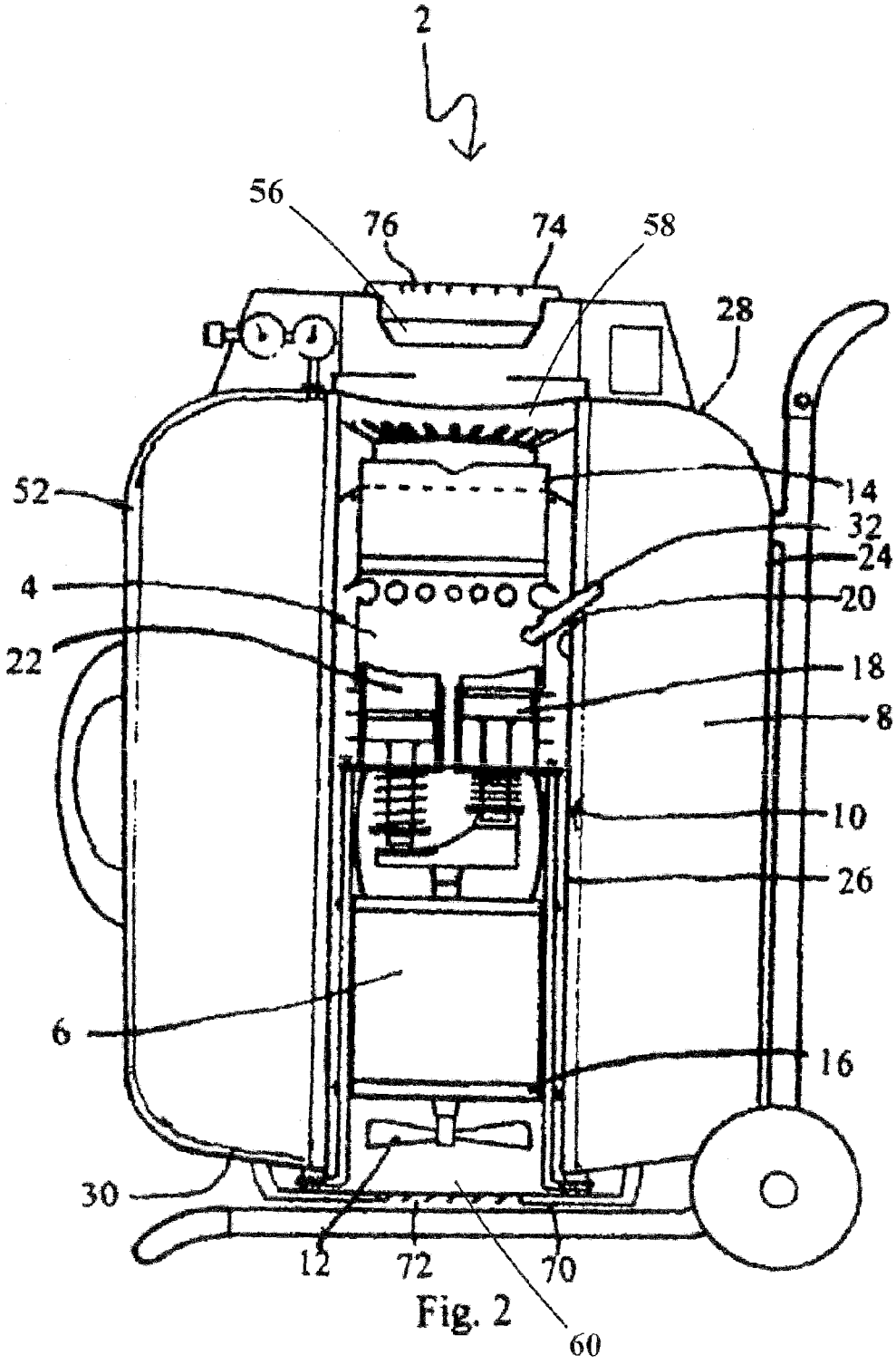
FIG. 2 is a cut-away elevational side view of the device of FIG. 1 showing the placement of the noise-producing elements.
Figure 3:
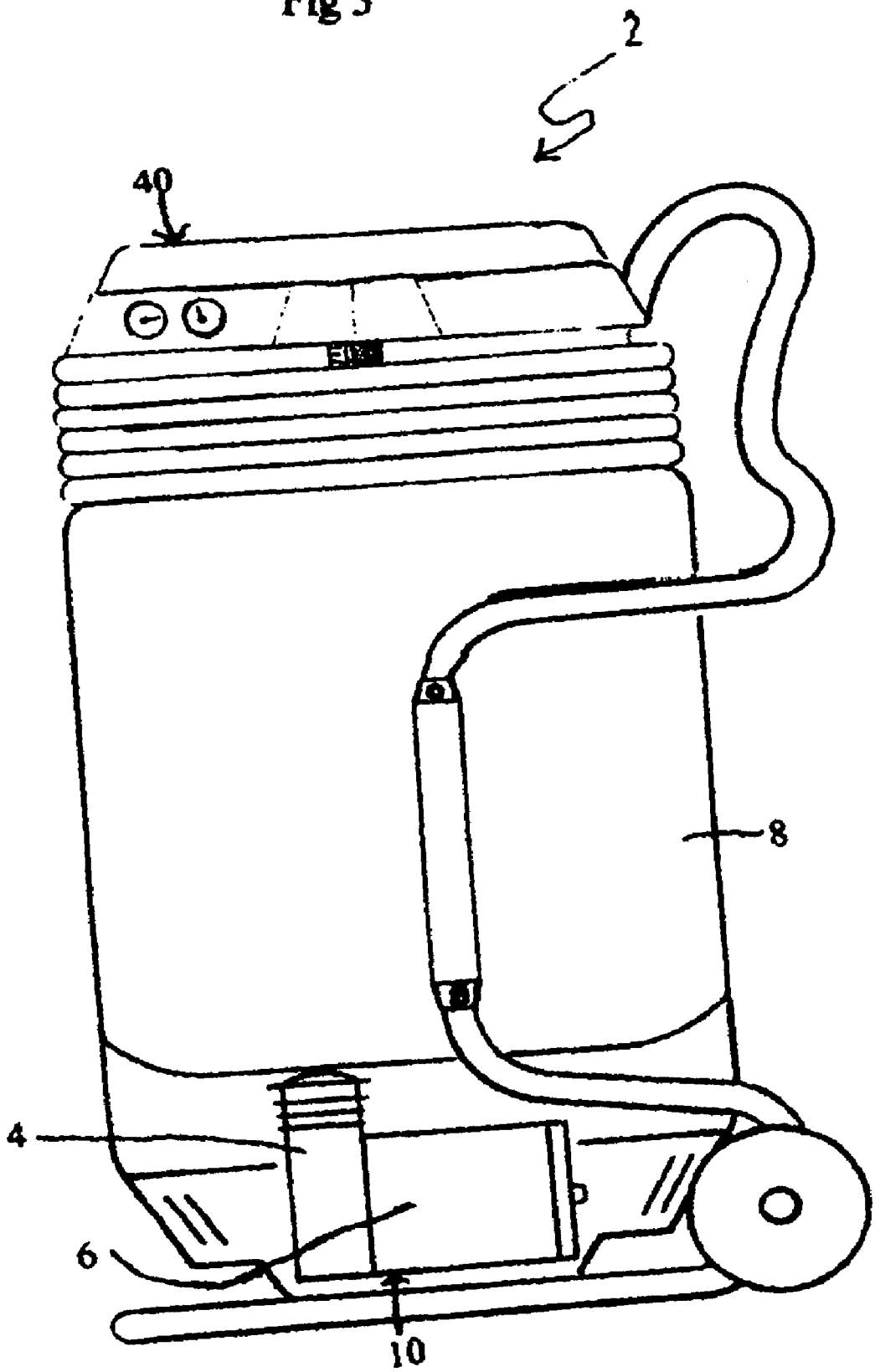
FIG. 3 is an elevational perspective view of another embodiment of the device of this invention.

In a first embodiment as shown in FIGS. 1-3, the storage tank 8 provides room for storage of the compressed fluid until needed. The room within the tank 8 is bounded by the inner walls of a closed outer cylindrical surface 23, a closed inner cylindrical surface 26, a closed outer top surface 28, and a closed outer bottom surface 30. The compressor/motor unit 10 and the fan 12 are of such a size and shape that they fit into the tunnel 18 created by the closed inner cylindrical surface 26 of the tank 8. A conduit 32 provided with a one-way valve (not shown) connects the compressor 4 with the storage tank 8.

In one embodiment of this invention, an outlet conduit 34 for pressurized fluids containing a gauge 36 and other controls conducts the compressed fluid from the tank.

In a separate embodiment, a utility attachment 40 fits over, and is attached to, the closed outer top surface 28. The utility attachment 40 contains an outlet conduit 34, gauges 36, and appropriate controls.

In the above embodiments, the opening 60 of the tunnel 20 has a bottom central cover 70 which contains a plurality of openings 72. The openings 72 allow for free release of the exhaust gases passing around the compressor/motor unit 10. These openings 72 can be of a different size, but are preferably smaller than the tunnel 20 to give a muffler-type effect.

The tunnel 20 has a top central cover 74 which contains adjustable louvers 76 and contains sound-absorbing foam insulation.

Any compressor/motor unit 10 will emit annoying and harmful noise. The object of the present invention is to eliminate or greatly reduce the amount of noise which reaches the ears of the user. Several features of the above-described device 2 are responsible for this noise reduction.

The top central cover 74 which is covered with a foam filter 56 prevents noise emanating from the compressor/motor unit 10 from getting out of the top central opening 58.

The bottom central opening 60 is covered by the bottom central cover 70, which helps to produce a muffled sound. The openings 72 in the bottom central cover 70 break up the noise emanating from the compressor/motor unit 10. Since the exhaust air can be released from the tunnel 20 through the bottom central cover opening 72, the noise created by the compressor/motor 10 does not echo and emanate through openings from which gas enters the device 2.

The compressor/motor unit 10 is held on the inside of the device 2 within the sound insulating walls of the inner cylindrical surface 26 of the tank 8. The tank 8 may be a single unit or may be comprised of two or more sections. The insulation caused by the compressed air between the inner 26 and outer cylindrical surfaces 24 of the tank 8 prevents noise from leaving the device 2 through the inner 26 and outer 24 cylindrical surfaces. The walls on the inside of the tank may be coated or lined with sound-reducing material such as foamed polymer or rubber to enhance the noise reduction of device 2.

It is appreciated that the relationships for the parts of the invention, to include variation in database and subsystem configuration to detach them for each other and provide the possibilities to deploy the system in different locations and under different authorities with division of labor, are deemed readily apparent and obvious to one of ordinary skill in the art, and all equivalent relationships in the above description are intended to be encompassed by the present invention.

In addition, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A device for compressing, storing, and releasing fluid, said device comprising:

a substantially annular tank with an outer surface forming a central inlet and a central exhaust positioned distally from said inlet, and an interior surface defining a tunnel disposed centrally within said tank extending from said inlet to said exhaust;

an inlet cover, at least partially obstructing said inlet, adapted to selectively control ingress of the fluid into said tunnel and having an absorption material;

a compressor, within said tunnel, in fluid communication with said tank;

a motor, within said tunnel, with a fan adapted to direct exhaust gas within said tunnel toward said exhaust; and an exhaust cover, at least partially obstructing said exhaust, having multiple exhaust apertures for egress of the exhaust gas from said tunnel, wherein said exhaust is positioned on said outer surface for direct atmospheric expulsion of exhaust gas from said tunnel, and wherein said central inlet, said central exhaust, said compressor, and said motor are arranged within said tunnel in a substantially co-axial relationship.

2. The device of claim 1 wherein said tunnel includes a substantially uniform diameter from said inlet to said exhaust.

3. The device of claim 1 wherein said tunnel includes an absorption material disposed thereon.

4. The device of claim 1 comprising multiple compressors.

5. The device of claim 4 comprising multiple motors.

6. The device of claim 1 further comprising a handle attached to said tank.

7. The device of claim 1 further comprising a dolly supporting said tank.

8. The device of claim 7 wherein said dolly includes an extendable handle.

9. A device for compressing, storing, and releasing fluid, said device comprising:

a substantially annular tank with an outer surface forming a central inlet and a central exhaust positioned distally from said inlet, and an interior surface bearing an absorption material and defining a tunnel, disposed centrally within said tank extending from said inlet to said exhaust, with a substantially uniform diameter from said inlet to said exhaust;

an inlet cover, at least partially obstructing said inlet, adapted to selectively control ingress of the fluid into said tunnel and having an absorption material;

a compressor, within said tunnel, in fluid communication with said tank;

a motor, situated in a substantially linear arrangement with respect to said compressor within said tunnel, with a fan adapted to direct exhaust gas within said tunnel toward said exhaust; and an exhaust cover, at least partially obstructing said exhaust, having multiple exhaust apertures for egress of the exhaust gas from said tunnel, and wherein said exhaust is positioned on said outer surface for direct atmospheric expulsion of exhaust gas from said tunnel.

10. The device of claim 9 comprising multiple compressors.

11. The device of claim 9 comprising multiple motors.

12. The device of claim 9 further comprising a handle attached to said tank.

13. The device of claim 9 further comprising a dolly supporting said tank.

14. The device of claim 13 wherein said dolly includes an extendable handle.

* * * * *